United States Patent [19]

Ganser et al.

[11] Patent Number: 4,891,563

[45] Date of Patent: Jan. 2, 1990

[54] CIRCUIT ARRANGEMENT FOR ADJUSTING THE OPERATING VOLTAGE OF HIGH-PRESSURE GAS DISCHARGE LAMPS

[75] Inventors: Hans G. Ganser, Stolberg; Ralf Schäfer, Aachen; Hans P. Stormberg, Stolberg, all of Fed. Rep. of Germany

[73] Assignee: U.S. Philips Corporation, New York, N.Y.

[21] Appl. No.: 732,479

[22] Filed: May 9, 1985

[30] Foreign Application Priority Data

May 14, 1984 [DE] Fed. Rep. of Germany ..... 3417794

[51] Int. Cl.[4] ..... H05B 41/36

[52] U.S. Cl. ..... 315/309; 315/116; 315/224

[58] Field of Search ..... 315/116, 224, 205, 307, 315/DIG. 7, 309; 340/642

[56] References Cited

U.S. PATENT DOCUMENTS

| | | | |
|---|---|---|---|
| 3,591,828 | 7/1971 | Washimi et al. | 315/108 |
| 3,886,405 | 5/1975 | Kubo | 315/246 |
| 4,037,148 | 7/1977 | Owens et al. | 315/284 |
| 4,039,895 | 8/1977 | Chermin et al. | 315/205 |
| 4,162,429 | 7/1979 | Elms et al. | 315/284 |
| 4,253,046 | 2/1981 | Gerhard et al. | 315/224 |
| 4,291,302 | 9/1981 | King et al. | 340/642 |
| 4,460,848 | 7/1984 | Fähnrich | 315/101 |
| 4,475,065 | 10/1984 | Bhalla et al. | 315/307 |

FOREIGN PATENT DOCUMENTS 104687 4/1984 European Pat. Off. .

*Primary Examiner*—Robert L. Griffin
*Assistant Examiner*—T. Salindong
*Attorney, Agent, or Firm*—Bernard Franzblau

[57] ABSTRACT

A circuit arrangement for adjusting the operating voltage of high-pressure gas discharge lamps to a given nominal value, comprises a controllable current limiter connected in series with the lamp and an adjustment circuit (3) for controlling the latter. The output signal of the adjustment circuit is determined by the difference between a given desired value determining the nominal lamp operating voltage and an actual value dependent upon the instantaneous lamp operating voltage. In parallel with the lamp (1) a heating element (5) is arranged which is in thermal contact with a temperature-dependent electrical element (6), which produces the actual voltage dependent upon the instantaneous lamp operating voltage.

20 Claims, 1 Drawing Sheet

CIRCUIT ARRANGEMENT FOR ADJUSTING THE OPERATING VOLTAGE OF HIGH-PRESSURE GAS DISCHARGE LAMPS

BACKGROUND OF THE INVENTION

This invention relates to a circuit arrangement for adjusting the operating voltage of high-pressure gas discharge lamps to a given nominal value comprising a controllable current limiter arranged in series with the lamp and an adjustment circuit controlling the current limiter. The output signal of the adjustment circuit is determined by the difference between a given desired value determining the nominal operating voltage and an actual value depending upon the instantaneous lamp operating voltage.

During operation of high-pressure gas discharge lamps, problems arise due to fluctuations of the lamp operating voltage, for example due to a variation of the AC house voltage and due to a variation of the lamp operating voltage during the life of the lamp, the latter being an ageing phenomenon. This may lead to an overload of the lamp and hence to a shortening of its life. Moreover, in sodium high-pressure discharge lamps having an increased sodium pressure an undesired effect occurs in that the color properties of the lamp also vary with the lamp operating voltage. Differences in the lamp operating voltage occur not only due to the aforementioned ageing phenomena during the lamp life, but may also be caused by manufacturing tolerances. Frequently, the lamp operating voltage increases during its life. However, a decrease of the operating voltage or a combination of both effects may also occur during this time.

Therefore, an adjustment of the lamp operating voltage to a given nominal value is also to be understood to mean that for each lamp of a given type, if operated by the aforementioned circuit arrangement, the same value of the operating voltage is adjusted. This does not correspond to a power stabilization because on account of manufacturing tolerances different power consumptions of the individual lamps may be required for obtaining the same lamp operating voltage. For the same reason, it is not possible either to stabilize only the lamp current.

U.S. Pat. No. 4,475,065 discloses a circuit arrangement of the kind mentioned in the opening paragraph, in which the operating voltage of high-pressure gas discharge lamps is adjusted when their instantaneous operating voltage exceeds the desired nominal operating voltage by more than 10%. For this purpose, a complicated and expensive adjustment circuit is used. However, a readjustment is not effected in the case of a decrease of the lamp operating voltage. Per volt variation of the lamp operating voltage, in the known circuit arrangement a variation of only 1.5% at most of the lamp power is permissible for adjustment of the lamp operating voltage because otherwise instabilities occur in the lamp.

However, such a small lamp power variation is not sufficient in all lamp types in order that variations of the lamp operating voltage can be compensated for satisfactorily.

SUMMARY OF THE INVENTION

Therefore, an object of the invention is to provide a circuit arrangement for adjusting the operating voltage of high-pressure gas discharge lamps, more particularly sodium vapor high-pressure gas discharge lamps, which permits an accurate adjustment of the lamp operating voltage to a given nominal value without instabilities occurring during operation of the lamp. Both operating voltages lying above the nominal value and operating voltages lying below this nominal value will be adjusted.

According to the invention, this object is achieved in a circuit arrangement of the kind mentioned in the opening paragraph in that a heating element is connected parallel to the lamp, this element being in thermal contact with a temperature dependent electrical element which produces the actual voltage that is dependent upon the instantaneous lamp operating voltage.

Depending upon the lamp operating voltage, the heating element is more or less strongly heated. The resistance losses P of the heating element R are related according to the equation $P=U_L^2/R$ with the lamp operating voltage $U_L$ and thus form a suitable quantity for stabilization of the operating voltage. These losses are then converted by heating of a temperature dependent electrical element into an electrically measurable and hence electronically controllable signal.

For example in the case of a jump-like variation of the lamp current due to fluctuations in the AC supply voltage, the thermal time constant of the lamp, i.e. the time elapsing between the corresponding jump-like initial variation of the operating voltage and the subsequent passage through the starting value lies, depending upon the lamp type, between several seconds and a few minutes. For a stable adjustment behavior, it is therefore advantageous for the thermal time constant of the unit comprising the heating element and the temperature dependent electrical element to be of the order of the thermal time constant of the lamp.

If it is desired to electronically adjust voltage variations with such large time constants, high-value expensive capacitors and operational amplifiers would be required for such adjustment circuits in order to keep leakage currents as small as possible. For this reason, in the circuit arrangement according to the invention, an adjustment circuit is used which does not comprise electronic integrators, but whose required adjustment time constant is attained by the unit comprising the heating element and the temperature dependent electrical element.

In an embodiment of the circuit arrangement according to the invention having relatively simple circuitry, the actual voltage is supplied, together with the desired voltage, to a differential, amplifier system whose output signal controls the controllable current limiter.

Preferably, the temperature dependent element is connected in series with a further electrical element and with a voltage source and the actual voltage is derived at the junction of the two elements. This arrangement can be realized in a simple manner and at a low cost.

In order to make the adjustment of the lamp operating voltage independent of a variation of the ambient temperature, according to a further embodiment of the invention, the desired voltage is controlled in dependence upon the ambient temperature. Variations of the ambient temperature can also be compensated for if the further electrical element, connected in series with the temperature dependent element thermally influenced by the heating element, is also temperature-dependent.

The temperature dependent element may be a temperature dependent resistor (NTC or PTC resistor), a silicon temperature sensor or a Zener diode having a temperature dependent Zener voltage. A temperature dependent resistor provides the most inexpensive solution having the highest possible insensitivity to interferences. Silicon temperature sensors have a smaller tolerance of the temperature characteristic than temperature dependent resistors. The said Zener diodes are even more accurate than silicon temperature sensors.

BRIEF DESCRIPTION OF THE DRAWING

In order that the invention may be readily carried into effect, it will now be described, by way of example, with reference to the accompanying drawing, in which.

DESCRIPTION OF THE PREFERRED EMBODIMENTS

Figure 1:
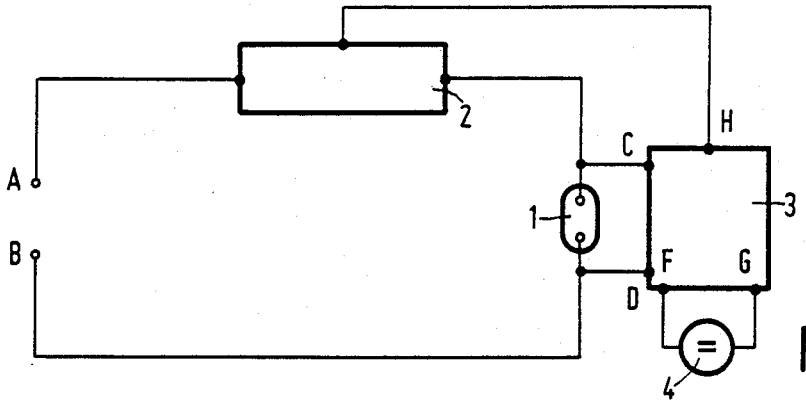
FIG. 1 shows a circuit arrangement for adjusting the operating voltage of a high-pressure discharge lamp comprising an adjustment circuit controlling the current limiter arranged before the lamp.

In the circuit arrangement shown in FIG. 1, input terminals A and B adapted for connection to an alternating voltage supply of, for example, 220 V, 50 Hz. To these input terminals is connected a series arrangement comprising a high-pressure discharge lamp 1 and a controllable current limiter 2. An adjustment circuit 3 is connected parallel to the lamp 1, which is more particularly a sodium high-pressure discharge lamp. The adjustment circuit is supplied at its first input C,D with the lamp operating voltage and at another input F,G with a given desired voltage determining the nominal lamp operating voltage. This desired voltage is produced by a direct voltage source 4. The adjustment circuit 3 produces at its output H a voltage when the lamp operating voltage averaged in time deviates from its nominal value. This output voltage is then supplied to the controllable current limiter 2, which reduces the lamp power if the lamp operating voltage lies above its nominal value, and which increases the lamp power if the operating voltage lies below its nominal value. An a result the lamp operating voltage is always readjusted to its nominal value.

As controllable current limiters, circuits comprising choke coils and triacs can be used, as described, for example, in U.S. Pat. Nos. 4,162,429, 3,886,405 and 4,037,148. Electronic switching mains parts, such as forward or fly-back converters, may also be utilized.

The adjustment circuit 3 shown in FIG. 2 will now be described. The lamp voltage applied to the first input C,D is supplied to a heating element in the form of a thermal resistor 5, which is connected parallel to the lamp 1 and is in thermal contact with a temperature dependent resistor 6, in this case an NTC resistor. Such constructional units are known under the designation "indirectly heated thermistors" and are commercially available as such or can be composed in a simple manner of thermal resistors and NTC resistors. This arrangement affords the advantage of a D.C. separation between the thermal resistor 5 connected to the lamp 1 and the NTC resistor 6, as a result of which the adjustment circuit 3 can be brought to an arbitrary potential, which makes it easier to drive the current limiter 2.

The time constant T, with which the NTC resistor 6 responds to variations of the lamp voltage applied to the thermal resistor 5, can be adjusted in a simple manner by a variation of the thermal coupling between a few seconds and a few minutes and can thus be adapted to the thermal time constant of the lamp 1. The NTC resistor 6 is connected in series with an ohmic resistor 7 and with a direct voltage source of, for example, 10 V and thus constitutes a voltage divider, at whose junction 8 between the two resistors 6 and 7 a voltage dependent upon the actual value of the lamp operating voltage is derived. This actual voltage is then supplied to the first input $E_1$ of a differential amplifier 9, while a desired voltage determining the nominal lamp operating voltage and originating from the direct voltage source 4 is supplied to its second input $E_2$. The differential amplifier 9 need not be a single amplifier, but may also consist of a suitable combination of several amplifiers. If the lamp operating voltage exceeds its nominal value, the thermal resistor 5 and hence the NTC resistor 6 thermally coupled with it are more strongly heated. Consequently, its resistance decreases with the time constant T, as a result of which the voltage at the input $E_1$ of the differential amplifier 9 exceeds the desired value determining the nominal lamp operating voltage. This then leads to a variation of the output voltage at the output H of the differential amplifier 9, which is also related to the time constant T. This output voltage controls the current limiter 2, which again produces a power variation reducing the overvoltage of the lamp 1. An analogous process with interchanged signs is obtained if the lamp operating voltage falls below its nominal value. The adjustment circuit 3 practically behaves like an integral controller.

Figure 2:
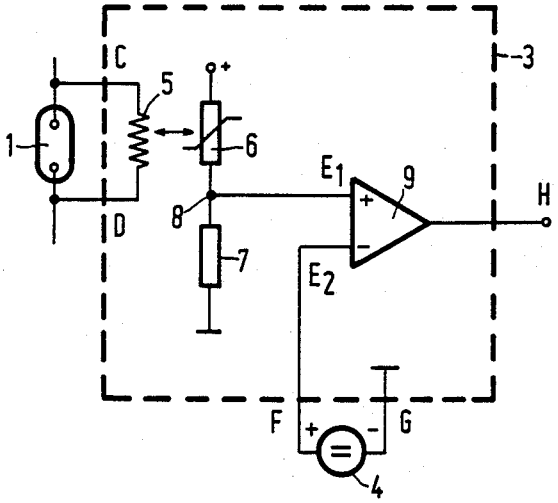
FIG. 2 shows an adjustment circuit for use in the circuit arrangement shown in FIG. 1 comprising a temperature dependent resistor.

A disadvantage of the adjustment circuit shown in FIG. 2 consists in that the voltage divider comprising the NTC resistor 6 and the ohmic resistor 7 also changes with fluctuations of the ambient temperature, which occurs especially with ballast units integrated in a lamp cap. This disadvantage can be avoided, however, if instead of the ohmic resistor 7, an NTC resistor is used whose temperature characteristic corresponds to that of the NTC resistor 6. If the second NTC resistor (7) is then arranged at a sufficiently large distance from the thermal resistor 5, the voltage divider ratio remains constant with variations of the ambient temperature.

Instead of the NTC resistor 6, use may also be made of a silicon temperature sensor (for example KTY 83 of Valvo). Such silicon temperature sensors generally have a smaller tolerance of the temperature characteristic then NTC resistors. Since silicon temperature sensors have a positive temperature coefficient, in this case, however, the inputs $E_1$ and $E_2$ of the differential amplifier would have to be interchanged.

Figure 3:
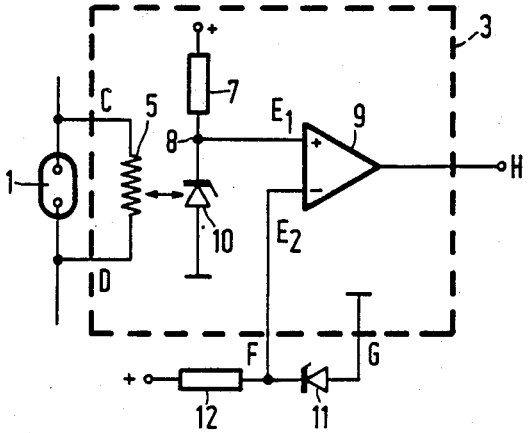
FIG. 3 shows an adjustment circuit also for use in the circuit arrangement shown in FIG. 1 comprising a Zener diode having a temperature dependent Zener voltage.

In the adjustment circuit shown in FIG. 3, a series arrangement of an ohmic resistor 7 and a Zener diode 10 having a temperature dependent Zener voltage is provided (for example TPD 0135 of Thomson CSF). When the lamp operating voltage increases, an increased heating of the Zener diode 10 takes place via the thermal resistor 5, as a result of which its Zener voltage increases. This leads in the same manner as in the circuit comprising NTC resistors (FIG. 2) to an increase of the voltage at the input $E_1$ of the differential amplifier 9. Furthermore, in this adjustment circuit a desired voltage is supplied to the input $E_2$ of the differential amplifier 9. This voltage is dependent upon the ambient temperature. For this purpose, a further series arrangement of a Zener diode 11 having a temperature dependent Zener voltage, an ohmic resistor 12 and a direct voltage source is provided. The junction between the Zener diode 11 and the resistor 12 derives a desired voltage dependent upon the ambient temperature. Thus, it is achieved that with variations of the ambient temperature the voltages at the inputs $E_1$ and $E_2$ of the differential amplifier 9 vary in approximately the same manner. Consequently, the output signal produced at the output H is approximately independent of the ambient temperature so that the adjusted lamp operating voltage also is not influenced by the ambient temperature.

What we claim is:

1. A circuit arrangement for adjusting the operating voltage of high-pressure gas discharge lamps to a given nominal value comprising, a controllable current limiter connected in series with the lamp and an adjustment circuit for controlling the current limiter, an output signal of the adjustment circuit being determined by the difference between a given desired value determining the nominal lamp operating voltage and an actual value dependent upon the instantaneous lamp operating voltage, characterized in that a heating element is connected parallel to the lamp, said heating element being in thermal contact with a temperature-dependent electrical element which produces the actual voltage dependent upon the instantaneous lamp operating voltage.

2. A circuit arrangement as claimed in claim 1, characterized in that the thermal time constant of the unit comprising the heating element and the temperature dependent electrical element is of the order of the thermal time constant of the lamp.

3. A circuit arrangement as claimed in claim 1, characterized in that the actual voltage is supplied together with the desired voltage to a differential amplifier which produces an output signal that controls the controllable current limiter.

4. A circuit arrangement as claimed in claim 1, characterized in that the temperature dependent element is connected in series with a further electrical element and with a voltage source and the actual voltage is derived at a junction of the two elements.

5. A circuit arrangement as claimed in claim 1 further comprising means responsive to ambient temperature for controlling the desired voltage in dependence upon said ambient temperature.

6. A circuit arrangement as claimed in claim 4, wherein the further electrical element is also temperature-dependent.

7. A circuit arrangement as claimed in claim 1, characterized in that the temperature dependent element comprises a temperature dependent resistor.

8. A circuit arrangement as claimed in claim 1, characterized in that the temperature dependent element comprises a silicon temperature sensor.

9. A circuit arrangement as claimed in claim 1, characterized in that the temperature dependent element comprises a Zener diode having a temperature dependent Zener voltage.

10. A circuit arrangement as claimed in claim 2 wherein the temperature-dependent element is connected in series with a further electrical element and a voltage source and the actual voltage is derived at a junction of the temperature dependent element and the further electrical element.

11. A circuit arrangement as claimed in claim 2 further comprising means responsive to ambient temperature for controlling the desired voltage in dependence upon the ambient temperature.

12. A circuit arrangement as claimed in claim 2 wherein the temperature dependent element comprises a temperature dependent resistor.

13. A circuit arrangement as claimed in claim 2 wherein the temperature dependent element comprises a Zener diode having a temperature dependent Zener voltage.

14. An apparatus for maintaining the operating voltage of a high-pressure discharge lamp at a given nominal value comprising: a pair of input terminals for connection to a source of supply voltage for the lamp, a controllable current limiter, means for connecting the controllable current limiter in series with a lamp across said input terminals, and an adjustment circuit for deriving an output signal determined by a difference between a given electric value which determines the desired nominal lamp operating voltage and an actual electric value dependent upon the instantaneous actual lamp operating voltage, and means for coupling said output signal to a control input of the current limiter so that the current limiter is controlled by said output signal of the adjustment circuit, characterized in that the adjustment circuit comprises a heating element connected in parallel with a lamp and in thermal coupling relationship with a temperature dependent electric element that produces said actual electric value.

15. An apparatus as claimed in claim 14 wherein the heating element and temperature dependent element together form a thermal unit having a thermal time constant approximately equal to the thermal time constant of a lamp to be operated by said apparatus.

16. An apparatus as claimed in claim 14 wherein a further electric element is connected in series circuit with the temperature dependent element across a voltage source and said actual electric value is a voltage derived at a tap point in said series circuit.

17. An apparatus as claimed in claim 16 wherein said further electric element comprises a temperature dependent element responsive mainly to ambient temperature so that the actual lamp operating voltage is independent of variations in the ambient temperature.

18. An apparatus as claimed in claim 14 further comprising means responsive mainly to ambient temperature for controlling the desired nominal lamp voltage as a function of the ambient temperature such that the actual lamp operating voltage is independent of variations in the ambient temperature.

19. An apparatus as claimed in claim 14 wherein a further temperature dependent element is connected in series circuit with the first temperature dependent element across a voltage source, said first and further temperature dependent elements being of the same type and exhibiting similar heat response characteristics.

20. An apparatus as claimed in claim 14 wherein said input terminals are intended for connection to a source of AC supply voltage at a frequency of approximately 50–60 Hz, and the thermal unit formed by said heating element and temperature dependent element produce a continuous control function in a given range above and below the nominal lamp operating voltage.

* * * * *